United States Patent [19]

Heiser

[11] 3,986,475

[45] Oct. 19, 1976

[54] CONTROL ARRANGEMENT

[76] Inventor: Kenneth R. Heiser, Rte. 1, Box 149, Lynnville, Ind. 47619

[22] Filed: May 3, 1976

[21] Appl. No.: 682,742

Related U.S. Application Data

[63] Continuation of Ser. No. 479,625, June 17, 1974, abandoned.

[52] U.S. Cl. ..... 114/144 R; 91/388; 91/460; 244/78

[51] Int. Cl.[2] ..... B63H 25/00

[58] Field of Search ..... 114/144 R, 162; 244/50, 244/78; 60/325, 464, 533, 552, 553; 180/79.2 R; 91/370, 388, 434, 460

[56] References Cited

UNITED STATES PATENTS

| | | | |
|---|---|---|---|
| 404,472 | 6/1889 | Dunn | 180/79.2 R |
| 593,871 | 11/1897 | Bain | 91/460 |
| 1,119,324 | 12/1914 | Sprater | 244/78 |
| 2,236,467 | 3/1941 | Clench | 91/460 |
| 3,468,126 | 9/1969 | Mercier | 91/388 |

*Primary Examiner*—Trygve M. Blix
*Assistant Examiner*—Charles E. Frankfort
*Attorney, Agent, or Firm*—Warren D. Flackbert

[57] ABSTRACT

An arrangement for achieving effective steering and control of any type of vehicle employing hydraulic follow-up, as, for example, the rudder of a vessel, where the components thereof are so related that the rudder will automatically follow the true position of the steering mechanism.

6 Claims, 4 Drawing Figures

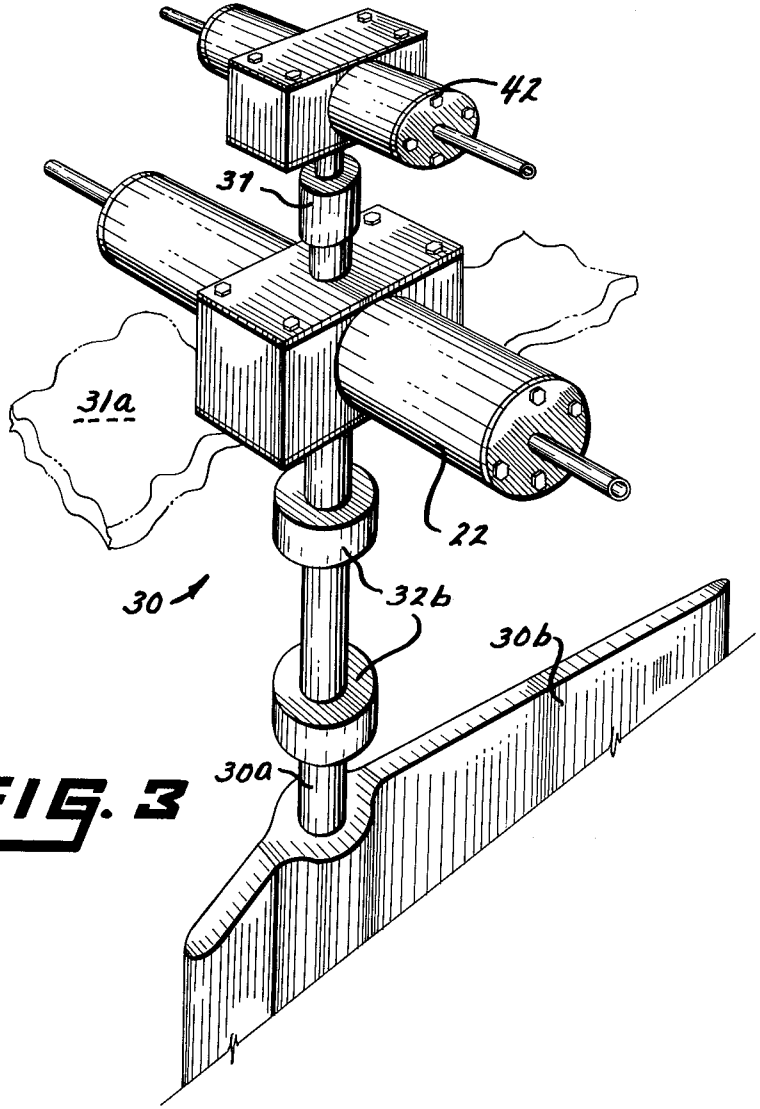
FIG. 3
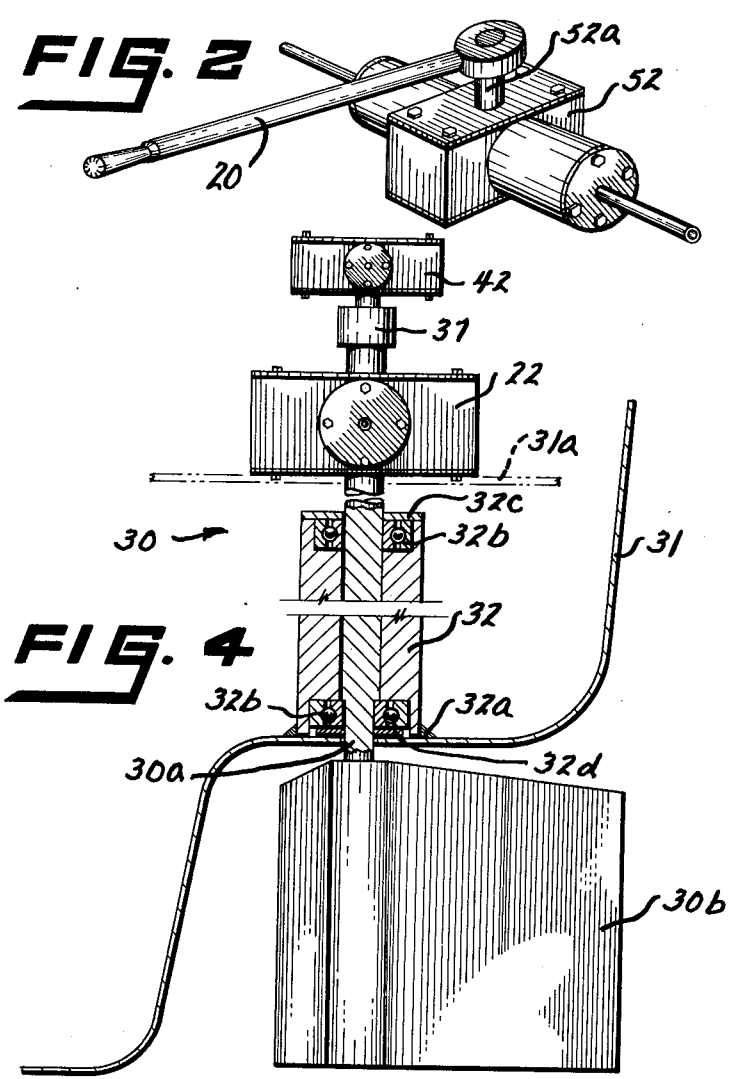
FIG. 2
FIG. 4

CONTROL ARRANGEMENT

This is a continuation of application Ser. No. 479,625, filed June 17, 1974 now abandoned.

As is known, and by reasons of illustration, the present approach to hydraulic rudder control, such as that used on river tug boats, requires, generally, a needle dial indicator, or like device, to visually correlate rudder position with the pilot steering lever position. If no such rudder position indicating device is employed, the pilot is forced to haphazardly guess as to the position of the rudder until a steering reaction is obtained upon movement of the vessel. Restated otherwise, therefore, the pilot must either continually monitor a rudder position indicating needle or merely "chance" rudder position from experience.

In contrast to the above, the invention provides an effective approach for overcoming the noted disadvantages, such being in the form of a system based on the employment of two rotary actuators, each being a "slave" to the other. Briefly, such rotary actuators are hydraulically interconnected and so related that the rudder automatically follows the true position of the steering lever, where a third rotary actuator, or a suitably arranged hydraulic cylinder, powers the rudder.

As a result, certain advantages accrue, including (1) the pilot's steering lever, if extended forwardly beyond its turning axis, always points in the direction in which the vessel is being steered, or conversely by system rearrangement; (2) a "feel" is produced by the pilot's steering lever largely equivalent to the effect of a pure mechanical system defined by levers and push rods; (3) any forces tending to move the rudder would be reflected in an equivalent movement of the pilot's steering lever; (4) the angular displacement of the pilot's steering lever always reflects the exact opposite angular displacement of the rudder, although by the reversal of the hydraulic lines, the same direction and angular displacement could be achieved; (5), and in conclusion, implementing (4), the pilot's steering lever would become the rudder position indicating device, permitting the pilot to determine true rudder position by "feel" and by visual observation.

In addition to the preceding, by the use of the override pressure produced in the servo system of the invention as a result of the pilot pushing the steering lever to the right or to the left, main hydraulic system pressure and flow, upon demand, is diverted to the main rudder actuator. In other words, the combination of elements defining the control arrangement cooperate to provide a certainty of performance nd utility.

A better understanding of the invention will become more apparent from the following detailed description, taken in conjunction with the accompanying drawings, wherein FIG. 1 is a schematic representation of a control arrangement in accordance with the teachings of the invention;

FIG. 2 is a perspective view of the pilot's steering lever assembly;

FIG. 3 is another perspective view, but, in this instance, directed to the rudder control assembly; and, FIG. 4 is a view in side elevation showing still further details of the rudder control assembly.

Figure 1:
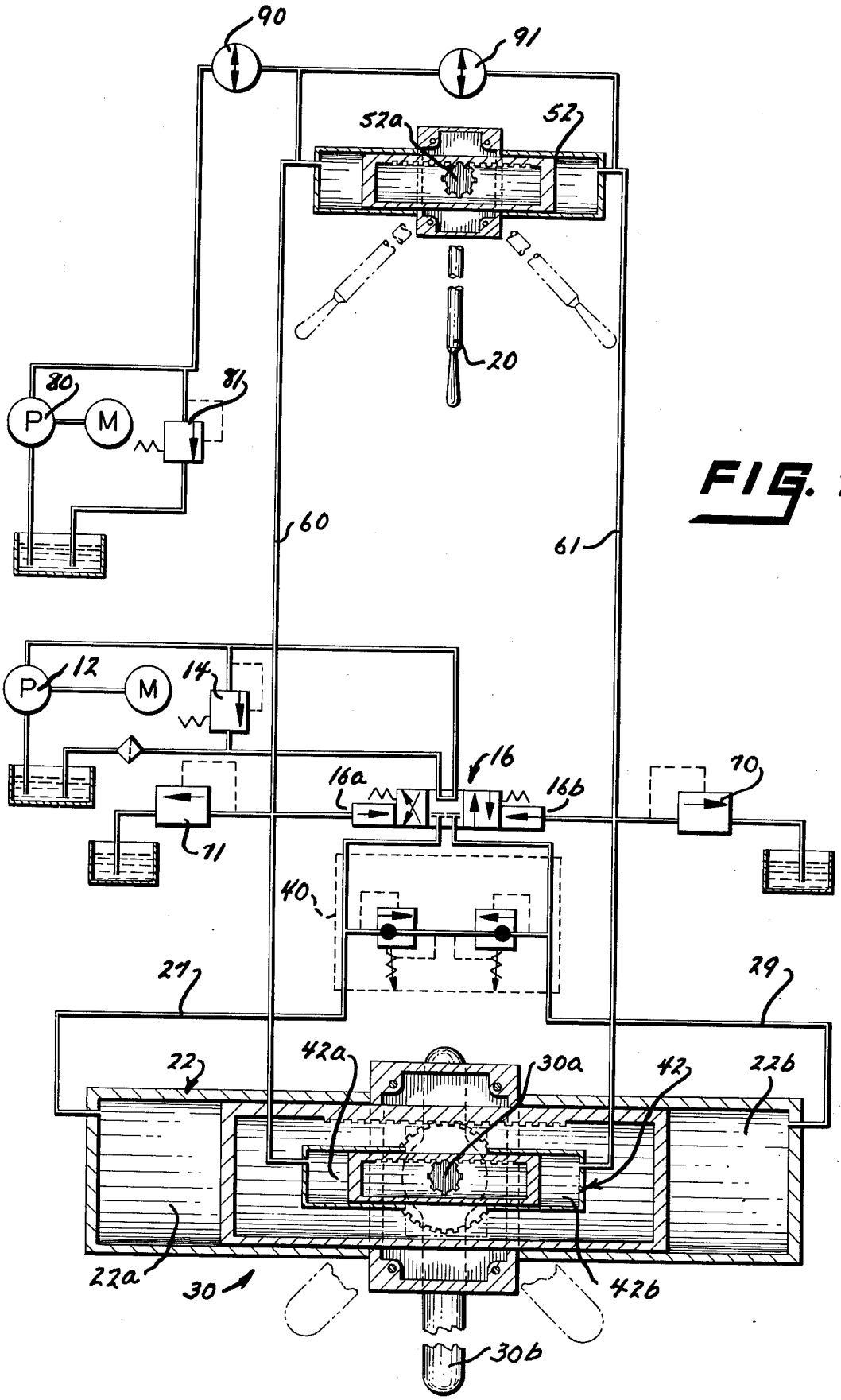

For the purposes of promoting a better understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further application of the principles of the invention being contemplated as would normally occur to one skilled in the art to which the invention relates.

Referring now to the figures, and particularly, at first, to FIG. 1, the instant control arrangement broadly comprises (1) a main high pressure hydraulic power system for operating the rudder or rudders of a vessel on which this illustration is based and (2) hydraulic interconnection machanism between a shaft of the aforesaid rudder(s) and a pilot's steering lever for purposes of control.

More specifically, and with reference to the main high pressure hydraulic power system, a motor-driven hydraulic pump 12, controlled by a relief valve 14, supplies hydraulic fluid power, in the described embodiment, to a four-way three-position fluid piloted directional control servo valve 16.

An over-ride demand from the pilot of the vessel, who pushes, either to the right or to the left, on a steering lever 20, actuates valve pilot 16*a* or 16*b* of the control servo valve 16, through hydraulic lines 60 and 61, where the servo valve 16 interconnects, through hydraulic lines 27 and 29, to a conventional rotary actuator 22, having ends 22*a* and 22*b*, controlling rudder movement.

The system further includes a rotary "slave" actuator 42 having ends 42*a* and 42*b*. In this latter connection, rotary actuator 42, affording rack-piston action, is directly attached to a shaft 30*a* for a rudder 30*b* of a rudder assembly 30 and in proper relation to the rudder position.

As evident in FIGS. 1, 3 and 4, the aforesaid conventional rotary actuator 22, also affording rack-piston action, forms part of the rudder assembly 30, being typically mounted on framework 31*a* (shown in phantom) of stern 31 of the vessel, and is attached to shaft 30*a* for rudder 30*b*. The shaft 30*a* includes a connector 37 for portions thereof.

The rudder 30*b* is disposed, in usual fashion, beneath stern 31, being supported on a mounting 32, representatively welded at 32*a* onto the inner surface of stern 31, and including bearings 32*b*, collar 32*c* and a seal 32*d* (see FIG. 4).

It might be noted at this time that a cross-over relief valve 40 is included in the system for protection from overpressurization should some other force, external, for example, cause a displacement of the rudder 30*b*.

It might be further noted that while the rudder assembly 30 encompasses, in spirit, one or more rudders 30*b*, for either forward or sideways movement, only one rudder is shown herein for simplicity in presentation.

Moreover, another rotary actuator 52, further affording rack-piston action, and identical in form to a rotary actuator 42, is disposed in the pilot compartment of the vessel, and the aforesaid steering lever 20 is placed on the output shaft 52*a* thereof. The aforementioned hydraulic lines 60 and 61 interconnect opposite ends of the rotary actuator 52 from the rotary actuator 42.

As a matter of added protection, relief valves 70 and 71 are utilized to further preclude overpressurization of the control arrangement. A motor-driven hydraulic pump 80, operating through a relief valve 81, is employed, but for the single purpose of supplying initial "fill" hydraulic fluid to the overall system and to initially position the rudder 30*b* by supplying pilot pressure to the servo valve 16.

Assuming that rudder 30*b* is set at any arbitrary position, shown by the broken lines in FIG. 1, the synchronization thereof with the pilot's steering lever 20 is accomplished as follows:

With valve 91 open, the pilot's steering lever 20 may be moved full left, which moves the piston of actuator 52 full right, passing hydraulic fluid from the right end of the actuator 52 through line 61. Valve 91 is then closed, trapping a full charge of hydraulic fluid in the left end of actuator 52, line 60 and valve pilot 16*a*. The main motor-driven hydraulic pump 12 is then actuated, providing hydraulic power to control servo valve 16.

Moving the pilot's steering lever 20 to the right will move the piston of actuator 52 to the left, forcing hydraulic fluid through hydraulic line 60 to end 42*a* of actuator 42. Noting that the force of hydraulic fluid cannot overcome the resistance presented by the piston of actuator 42, the hydraulic fluid will actuate valve pilot 16*a*, causing the control servo valve 16 to shift and allowing power assist from the main hydraulic pump 12. Hydraulic fluid power is thus provided to the end 22*a* of rudder control actuator 22 through hydraulic line 27. the preceding causes the rudder 30*b* to be moved to a full left position.

Once the latter is accomplished, valve 91 is opened and the pilot's steering lever 20 moved to a full right position, causing hydraulic fluid in the left end of actuator 52 to pass through valve 91 to the right end of actuator 52. The hydraulic fluid between lines 60 and 61 and the pistons of actuators 52 and 42 is equalized. Such action places the pilot's steering lever 20 in an equal and opposite position to that of the rudder 30*b*.

In other words, the pilot's steering lever 20 and rudder 30*b* will now be synchronized in equal and opposite directions. Thus, when the pilot's steering lever 20 is moved to the right, the rudder 30*b* will move in an equal and opposite direction, causing the vessel to turn left. Restated, the pilot's steering lever 20 points in the direction to which the vessel will turn.

Therefore, with the motor-driven control pump 12 operating, the steering of the vessel is readily accomplished by moving or pivoting the pilot's steering lever 20. As mentioned, with the arrangement as organized herein, movement of the pilot's steering lever 20 to the right would steer the vessel to the left, and conversely, but such results could be reversed, if desired, by interchanging hydraulic lines 60 and 61 at actuator 52.

During normal steering operation, the pilot pushes the steering lever 20 several degrees right or left of a given position to produce an over-riding pressure on the control servo valve 16, i.e. either valve pilot 16*a* or 16*b* thereof. If the over-riding pressure is not sufficient to move the piston in the actuator 42, then pilot valve 16*a* or 16*b*, depending upon the desired steering direction, would be actuated by fluid pressure in hydraulic lines 60 or 61, thus causing servo valve 16 to shift in the appropriate direction. Such allows the main hydraulic system to supply hydraulic fluid to the appropriate end of actuator 22, and to cause the piston thereof to move and therefore operate the rudder 30*b*.

When the rudder shaft 30*a* moves by action of the rotary actuator 22, and since rudder shaft 30*a* is also connected to the rotary actuator 42, the piston in the rotary actuator 42 forces hydraulic fluid through hydraulic lines 60 or 61, causing an equal follow-up action on the pilot's steering lever 20. Any piston movement in rotary actuator 42 produces an equal and opposite follow-up action in rotary actuator 52, meaning that the displacement of rudder 30*b* would equal that of the "slave" rotary actuators 52 and 42.

Thus, from the preceding, it should be apparent that a control arrangement is provided herein adaptable for any vehicle, not limited to a vessel, having the necessity for hydraulic follow-up. The invention represents a minimum number of conventional components, where, it might be noted, that the indicated valve reservoirs in the drawings would probably be actually, a single unit, rather than the illustrated separate units.

The above description, therefore, is representative of an effective approach for vehicle control, the arrangement being susceptible to changes within the spirit of the invention. In this connection, certain component substitution is achievable, as, for example, the rotary actuators, which are purchased parts, available from various sources; proportioning changed; and, mounting structure altered to satisfy environmental conditions. Thus, the discussion hereabove should be considered illustrative and not as limiting the scope of the following claims.

I claim:

1. A control arrangement for a vessel having a steering mechanism and a rudder comprising a hydraulically interconnected first rack and pinion actuator, second rack and pinion actuator and third rack and pinion actuator, said first rack and pinion actuator controlled by movement of an external steering device and selectively hydraulically operating said third rack and pinion actuator, said second rack and pinion actuator hydraulically movable with said first rack and pinion actuator, and said third rack and pinion actuator controlling movement of said rudder, said movement of said rudder directly moving said second rack and pinion actuator and simultaneously hydraulically moving said first rack and pinion actuator.

2. The control arrangement of claim 1 where said rudder, said second rack and pinion actuator and said third rack and pinion actuator are powered on a common shaft.

3. the control arrangement of claim 1 where a valve means interconnected with said third rack and pinion actuator establishes a hydraulic fluid by-pass from one powered end of said third rack and pinion actuator to another powered end thereof and balance hydraulic fluid pressures.

4. The control arrangement of claim 1 including a main hydraulic power system for said first rack and pinion actuator said second rack and pinion actuator and said third rack and pinion actuator, and servo means interconnected between said first rack and pinion actuator, said second rack and pinion actuator and said third rack and pinion actuator to selectively unload said main hydraulic power system at a condition demanding no movement of said rudder.

5. The control arrangement of claim 1 including servo means and valve means interconnected with said third rack and pinion actuator to maintain said rudder at a given position of said steering device.

6. The control arrangement of claim 4 where said servo means interconnects said first rack and pinion actuator, said second rack and pinion actuator and said third rack and pinion actuator to permit movement of said steering device in the event of a failure of said main hydraulic power system.

* * * * *